US006827559B2

(12) United States Patent
Peters et al.

(10) Patent No.: US 6,827,559 B2
(45) Date of Patent: Dec. 7, 2004

(54) PIEZOELECTRIC MICROPUMP WITH DIAPHRAGM AND VALVES

(75) Inventors: Richard D. Peters, Gahanna, OH (US); David Rust Busick, Lewis Center, OH (US); Theodore Robert Adams, Dublin, OH (US)

(73) Assignee: Ventaira Pharmaceuticals, Inc., Columbus, OH (US)

( * ) Notice: Subject to any disclaimer, the term of this patent is extended or adjusted under 35 U.S.C. 154(b) by 0 days.

(21) Appl. No.: 10/187,423

(22) Filed: Jul. 1, 2002

(65) Prior Publication Data

US 2004/0001767 A1 Jan. 1, 2004

(51) Int. Cl.[7] ..... F04B 17/00

(52) U.S. Cl. ..... 417/413.2; 417/413.1; 417/248

(58) Field of Search ..... 417/413.1, 413.2, 417/243, 571, 244

(56) References Cited

U.S. PATENT DOCUMENTS

| | | | | |
|---|---|---|---|---|
| 3,029,743 A | | 4/1962 | Johns | |
| 3,174,433 A | | 3/1965 | Roosa | |
| 3,339,094 A | | 8/1967 | Shopsky | |
| 3,483,823 A | | 12/1969 | Palmer | |
| 3,657,930 A | | 4/1972 | Jacobson | |
| 3,963,380 A | | 6/1976 | Thomas, Jr. et al. | |
| 4,344,743 A | | 8/1982 | Bessman et al. | |
| 4,708,600 A | | 11/1987 | AbuJudom, II et al. | |
| 4,938,742 A | | 7/1990 | Smits | |
| 4,939,405 A | | 7/1990 | Okuyama et al. | |
| 4,944,659 A | * | 7/1990 | Labbe et al. | 417/413.2 |
| 4,983,876 A | | 1/1991 | Nakamura et al. | |
| 4,995,864 A | | 2/1991 | Bartholomew | |
| 5,171,132 A | | 12/1992 | Miyazaki et al. | |
| 5,259,737 A | | 11/1993 | Kamisuki et al. | |
| 5,362,213 A | | 11/1994 | Komatsu et al. | |
| 5,525,041 A | | 6/1996 | Deak | |
| 5,611,676 A | | 3/1997 | Ooumi et al. | |
| 5,759,014 A | | 6/1998 | Van Lintel | |
| 5,759,015 A | | 6/1998 | Van Lintel et al. | |
| 5,816,780 A | | 10/1998 | Bishop et al. | |
| 6,033,191 A | | 3/2000 | Kamper et al. | |
| 6,042,345 A | | 3/2000 | Bishop et al. | |
| 6,062,212 A | | 5/2000 | Davison et al. | |
| 6,116,866 A | * | 9/2000 | Tomita et al. | 417/413.2 |
| 6,203,291 B1 | * | 3/2001 | Stemme et al. | 417/413.3 |
| 6,261,066 B1 | | 7/2001 | Linnemann et al. | |
| 6,302,331 B1 | | 10/2001 | Dvorsky et al. | |
| 6,368,079 B2 | | 4/2002 | Peters et al. | |
| 6,481,984 B1 | * | 11/2002 | Shinohara et al. | 417/413.2 |

FOREIGN PATENT DOCUMENTS

| | | |
|---|---|---|
| EP | 0134614 | 3/1985 |
| JP | 61-43283 | 3/1986 |
| JP | 3-134272 | 6/1991 |
| SU | 846786 | 7/1981 |
| WO | WO 00/39463 | 7/2000 |

OTHER PUBLICATIONS

Van Lintel, H.T.G. et al., "A Piezoelectric Micropump Based on Micromachining of Silicon," *Sensors& Actuators, 15*, pp. 153–167 (1988).

* cited by examiner

*Primary Examiner*—Justine R. Yu
*Assistant Examiner*—William H. Rodriguez
(74) *Attorney, Agent, or Firm*—Thompson Hine LLP

(57) ABSTRACT

A micropump comprising a pump body including a fluid inlet channel, a fluid outlet channel and pumping reservoir, the fluid inlet channel and the fluid outlet channel communicating with the pumping reservoir, a diaphragm covering the pumping reservoir, a piezoelectric strip actuator attached to the diaphragm such that by applying a voltage to the actuator, the diaphragm can be raised or lowered relative to the pumping chamber, a valve on the inlet channel and the outlet channel, the valve opening and closing the inlet and the outlet channel in response to the raising and lowering of the diaphragm.

25 Claims, 10 Drawing Sheets

PIEZOELECTRIC MICROPUMP WITH DIAPHRAGM AND VALVES

BACKGROUND

This invention relates to a piezoelectric micropump and to methods and apparatuses for pumping fluid in small volumes and at controlled flow rates using a micropump employing a diaphragm and a piezoelectric strip actuator.

Numerous fluidics applications in such areas as medicine, chemistry, and environmental testing exist on a small scale for reasons of sample size, reagent costs, or portability. Cost-effective fluidics including pumps, that are capable and reliable are required for such small scale systems. A number of micropumps are known for delivering small amounts of a fluid to a delivery point. Some of the pumps include piezoelectric actuators. U.S. Pat. No. 4,938,742 to Smits describes a micropump with piezoelectric valves. These valves contain a diaphragm covered by a single layer of piezoelectric material, which limits the control and deflection of the valves. Some of the principles involved in piezoelectric micropumps are described in *Piezoelectric Micropump Based Upon Micromachining of Silicone*, Sensors & Actuators, 15, 1988 pp. 153–167.

U.S. Pat. No. 4,939,405 to Okuyama et al. discloses a piezoelectric vibrator pump in which a piezoelectric vibrator is mounted in a housing. The vibrator pump does not employ a diaphragm. Instead the vibrator itself is coated with plastic. The pump includes a suction inlet line and a discharge outlet line both of which contain non-return values that alternately open and close in response to the vibration of the vibrator.

U.S. Pat. No. 5,611,676 to Ooumi et al. discloses the use of a cantilevered piezoelectric bimorph. A piezoelectric bimorph has two layers of a piezoelectric material separated by a shim. The application of an electric field across the two layers of the bimorph causes one layer to expand while the other contracts. This causes the bimorph to warp more than the length or thickness deformation of the individual layers.

Another example of a micropump is described in International Patent Application WO 98/51929 to Fraunhofer. Fraunhofer discloses a piezoelectric micropump that is constructed from two silicone wafers each of which includes a valve flap structure and a valve seat structure. The two wafers are juxtaposed and bonded together such that the flap structure in one wafer overlies the valve structure in the other wafer. The micropump is disclosed as being self-priming and suitable for conveying a compressible media.

Commonly assigned U.S. Pat. No. 6,368,079 to Peters describes a micropump which includes a plurality of diaphragm pumping chambers that are actuated by a cantilever mounted piezoelectric strip actuator.

The present invention provides a new and improved piezoelectric micropump.

SUMMARY OF THE INVENTION

In accordance to one aspect of the present invention a micropump for pumping a fluid is disclosed that includes a pump body. The pump body includes a fluid inlet channel and a fluid outlet channel, and a pumping chamber. The fluid inlet channel and the fluid outlet channel directly or indirectly communicate with the pumping chamber. The pumping chamber is formed between a plastic diaphragm and a reservoir in the pump body. A piezoelectric strip actuator is attached to the diaphragm such that by applying a voltage to the actuator, the actuator is deformed and the diaphragm is raised or lowered. In accordance with one embodiment of the invention, a reed valve is provided on the inlet and outlet channel. These reed valves open and close the inlet and outlet channels in response to raising and lowering the diaphragm. In one embodiment of the invention, pressures up to about 20 psi and flow rates up to about 100 $\mu$l/sec and more typically up to about 50 $\mu$l/sec are achieved.

In accordance with the invention, the micropump may include one or more pumping chambers. The term "pumping chamber" as used herein includes any chamber formed between an actuated diaphragm and a reservoir in the pump body. The term includes a chamber that functions as a volume accumulator.

In another embodiment of the invention, the micropump includes two or more pumping chambers that may be the same or different volume. In one embodiment, the ratio of the stroke volume of the first pumping chamber to the stroke volume of the second pumping chamber is about 2:1 but the ratio can vary from about 2:1 to 1:1 depending upon the application of the pump.

The diaphragm for the second chamber may be attached to the same piezoelectric actuator that actuates the diaphragm for the first chamber or to a different individually or independently operated actuator. Where the same actuator is attached to both diaphragms, the actuator may be double acting, i.e., the pumping chambers operate 180° out of phase with one another. By applying a first voltage to the actuator, the first diaphragm can be raised while the second diaphragm is lowered, and by applying a second voltage (i.e., reversing the polarity of the first voltage), the first diaphragm can be lowered while the second diaphragm is raised.

Micropumps can be designed having sequentially actuated diaphragms and used for a variety of different applications or purposes. In one embodiment, the second pumping chamber may function as a volume accumulator. The outlet from the first pumping chamber directly or indirectly communicates with the inlet to the volume accumulator and the volume accumulator includes a second fluid outlet from which fluid is discharged. Micropumps including two pumping chambers connected in series in this manner can be designed to provide more constant fluid output than a micropump which includes a single pumping chamber. With a micropump having a single pumping chamber, the output occurs in pulses when the diaphragm is lowered or compressed but not when it is raised. If the first chamber is larger than the volume accumulator (e.g., twice as large), a unit of discharge can be achieved with each raising and lowering of the second pumping chamber diaphragm thereby providing more constant output and reducing pulsation.

In another embodiment of the invention, the micropump may be constructed with two or more pumping chambers that are activated sequentially such that fluid is expelled from one chamber as it is drawn into a second chamber. The second chamber volume can vary but for most applications it will be smaller or equal in volume to the first chamber.

In still another embodiment of the invention, the micropump can be constructed with a plurality of pumping chambers having diaphragms that can be actuated individually by dedicated actuators. In accordance with one example of this embodiment of the invention, a micropump can be provided wherein one pumping chamber pumps a liquid composition while the other pumping chamber pumps a gas such as air. The pumped air can be used to purge a line or element in the fluidic flow of the first pumping chamber. In one embodiment, air is used to purge a spray nozzle that is directly or indirectly supplied with liquid from the first pumping chamber.

In accordance with one embodiment of the invention, the reed valve is formed by a film of a flexible polymer that may be either low flex modulus or high flex modulus, such as a KAPTON (aromatic polyimide) film (KAPTON is a trademark of the E. I. DuPont Company). Preferably, the reed valve is formed from a low flex modulus film. In one embodiment a cut out defining a flap which functions as the reed valve is cut in the film. In another embodiment, the film may include a first cut out defining a first flexible flap that functions as an inlet valve and a second cut out defining a second flexible flap that functions as the outlet valve. One of the flaps may be located over a valve seat at the mouth of the inlet channel and the other flap may be located over a valve seat at the mouth of the outlet channel.

BRIEF DESCRIPTION OF THE DRAWINGS

The invention will be described in detail in this specification and illustrated in the accompanying drawings which form a part hereof wherein.

DETAILED DESCRIPTION

Figure 1:
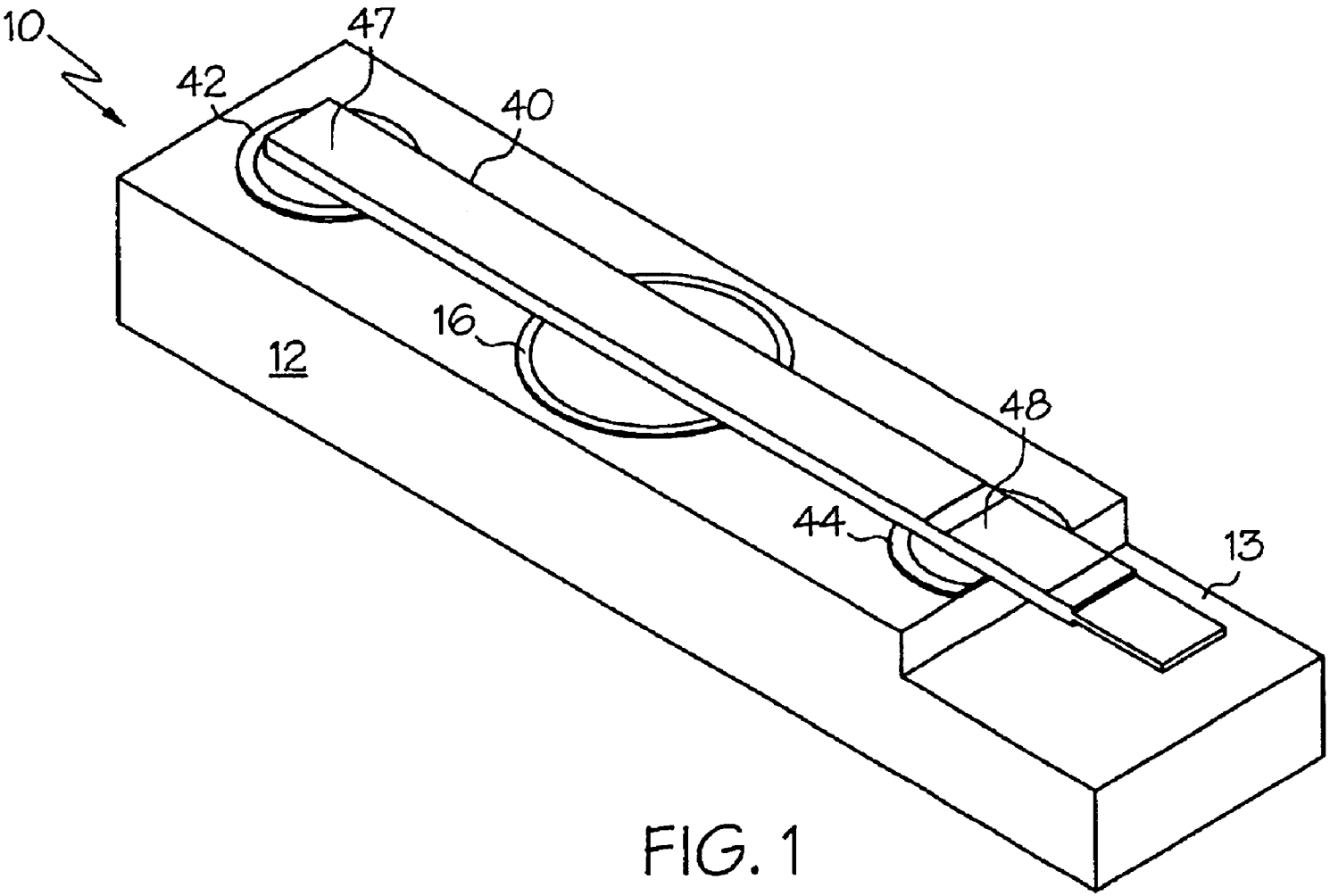
FIG. 1 is a perspective view of a piezoelectric micropump having a single pumping chamber.

Referring now to the drawings which are provided, FIG. 1 is a perspective view of a micropump 10 in accordance with one embodiment of the invention. The micropump 10 includes a pump body 12. In this embodiment, the pump body 12 includes a single pumping chamber (internally) that includes a diaphragm 16 on the surface of the pump body. The pump body 12 includes a recessed area 13 in which a group of electrical probes can be mounted as illustrated below in FIG. 8. The pump body 12 may be made of an injection molded or machined plastic such as DELRIN, an acetal resin available from E. I. DuPont Co. The material forming the pump body is selected to be compatible with the fluid that is pumped through the micropump.

Figure 13:
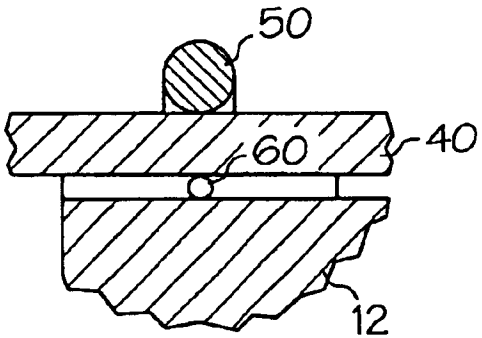
FIG. 13 is a cross-sectional view of the actuator mount shown in FIG. 12.
Figure 12:
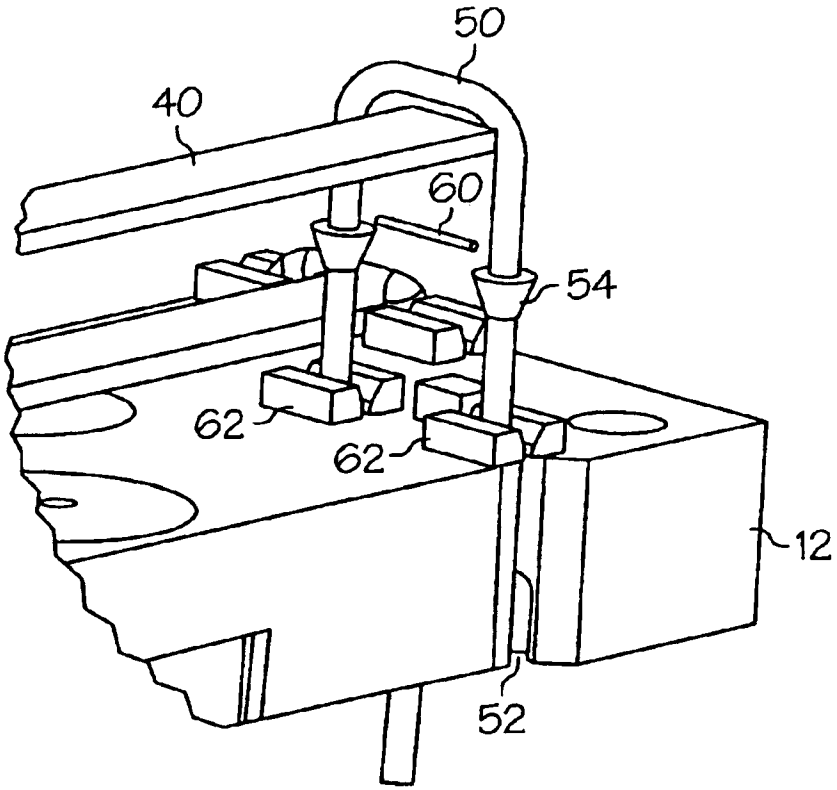
FIG. 12 is an exploded view of a micropump actuator mount in which the actuator is pinned on a wire pivot.

An actuator 40 is mounted on the upper surface of the pump body. The actuator is pinned to the pump body near each of its ends by a pair of spacer elements 42 and 44. The term "pinned" as used herein refers to a relatively flexible mount that permits the ends of the actuator to rock or flex up and down as the actuator vibrates. In one embodiment, the spacer elements 42 and 44 may be formed from the same material as the diaphragm 16. The actuator may be bonded to the spacers and the diaphragm using an adhesive 45 as described in more detail below. This mount is relatively flexible and permits rocking at the ends of the actuator. A more rigid mount could be used as an alternative mount but it has been found that greater deflection that can be achieved if the ends are able to rock as described herein. In another embodiment of the invention the actuator 40 can be clamped at one end to the pump body 12 to provide a cantilevered mount as shown in commonly assigned U.S. Pat. No. 6,368,079. In still another embodiment the actuator is pinned on a wire as shown in FIGS. 12 and 13.

Figure 2:
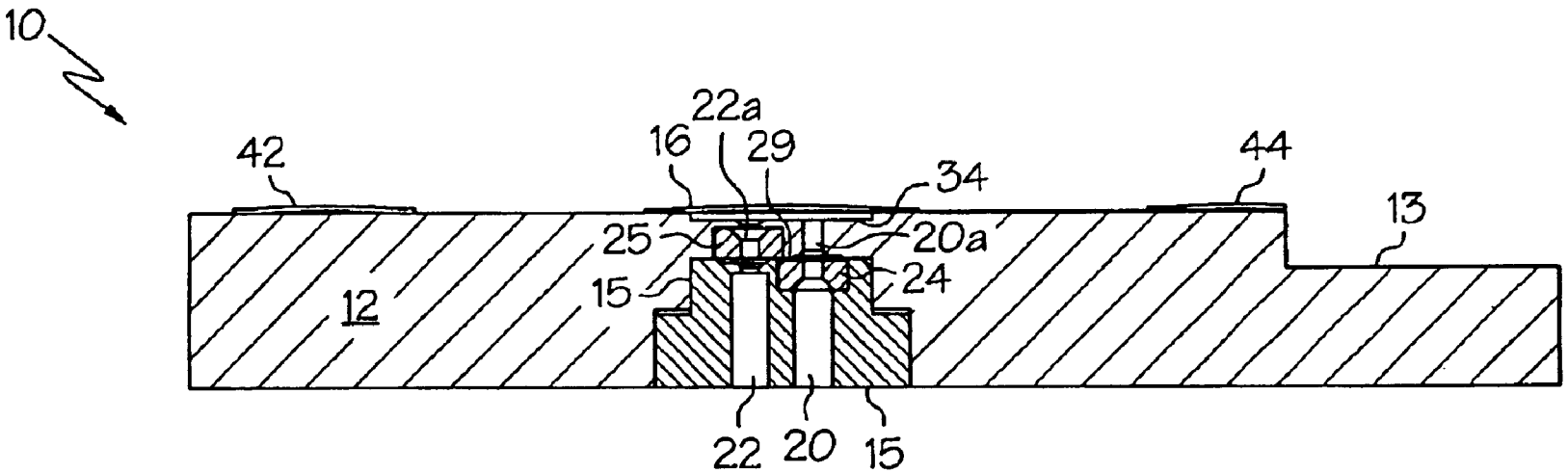
FIG. 2 is a partial cross-section of the micropump of FIG. 1.
Figure 3:
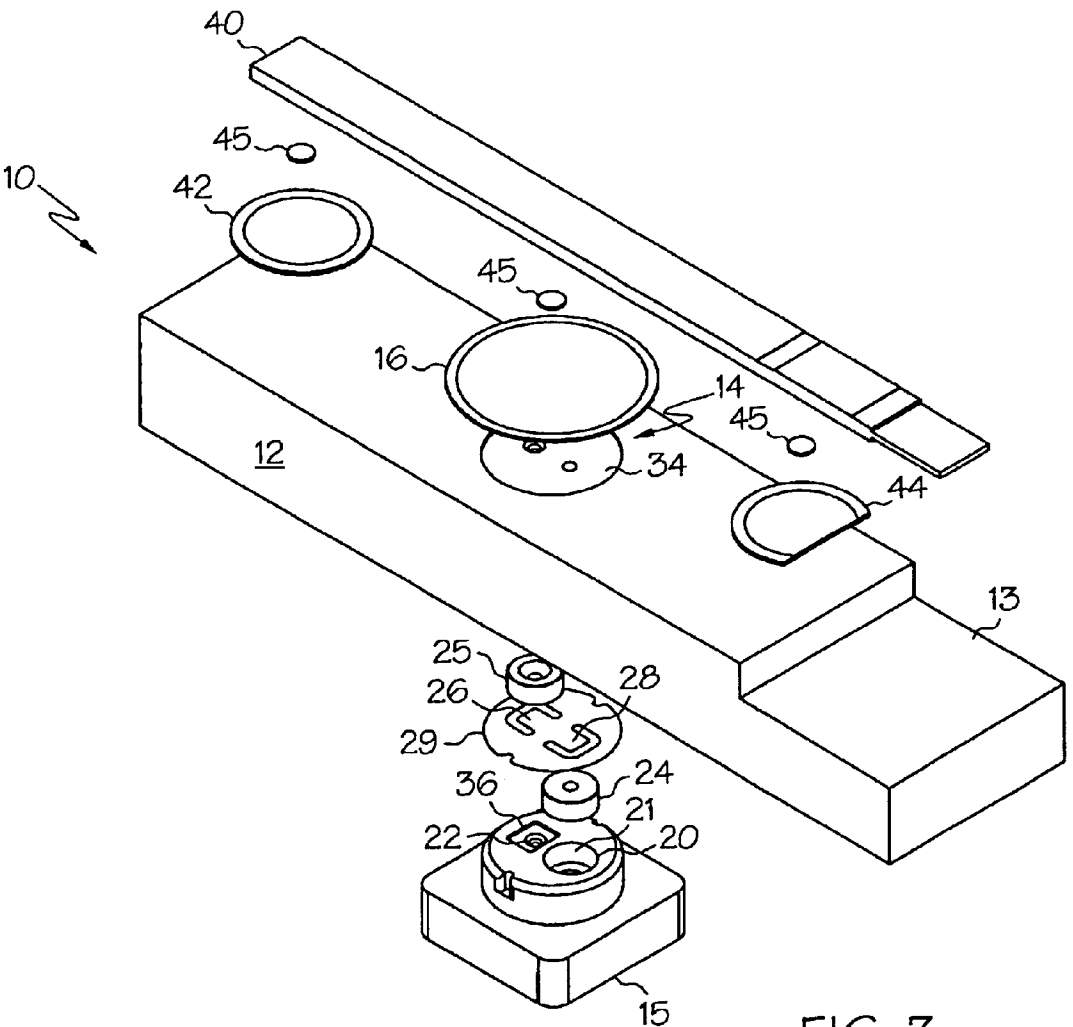
FIG. 3 is an exploded view of the micropump of FIG. 1.

The micropump 10 is shown in more detail in FIGS. 2 and 3. In the illustrated embodiment, the pump 10 includes a modular pump insert 15 that is received into a matching cavity in the pump body 12. Insert 15 may be retained within the pump body by a press fit. The use of insert 15 simplifies manufacture and assembly of the micropump. The insert 15 has molded or machined within it an inlet channel 20 and an outlet channel 22. In this embodiment, the micropump also includes a pair of vee-jewels 24 and 25. A film 29 in which the reed valves 26 and 28 are cut (FIG. 4) is captured between the pump body 12 and the insert 15 as described below. While the micropump may be constructed using insert 15 as illustrated, those skilled in the art will appreciate that the structures of the insert can be molded, microetched or micromachined directly into the pump body using conventional techniques.

In one embodiment the pumping chamber may have a stroke volume of about 0.10 to 10 $\mu$l and more typically about 0.3 to 0.8 $\mu$l. For many applications, it is desirable if the pump is self-priming, i.e., the pump is able to pump gases and liquids. To provide self-priming ability, the dead volume and cracking pressure are minimized.

Figure 4:
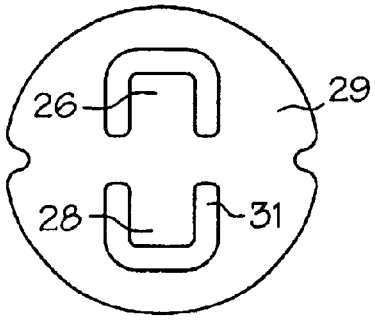
FIG. 4 illustrates a reed valve.

In the embodiment illustrated in FIG. 3, the pumping chamber insert 15 includes a inlet channel 20 and an outlet channel 22. The inlet channel 20 is widened at its mouth 21 so that it can receive a vee-jewel 24. The vee-jewel 24 is a highly polished element that includes a channel that runs down its center axis. One face of the vee-jewel 24 includes a frustoconical surface that is designed to seat a ball valve (this surface is not used in this invention) while the opposite face is flat. The vee-jewel 24 is inverted such that its flat face is oriented so that the reed valve 28 seats against the highly polished flat surface of the base of the vee-jewel 24. To facilitate manufacture the reed valves can be formed in a single film. As shown in FIG. 4, reed valves 26 and 28 are formed by U-shaped cut outs 31 in a flexible polymeric film 29. The film 29 is captured internally between the insert 15 and the pump body 12. Outlet reed valve 26 is located over the outlet channel 22 and inlet reed valve 28 is located over the inlet channel 20. Reed valves 26 and 28 open and close in opposite directions in response to the pressure changes in the reservoir 34. To prevent the outlet reed valve 26 from closing the outlet channel 22 when the diaphragm 16 is lowered, the mouth 36 of the outlet channel 22 is recessed as shown.

The micropump that is illustrated can be assembled by inserting vee-jewel 25 into a cavity in the pump body 12 followed by inserting the reed valve film 29 into the cavity in the pump body 12 oriented such that the valve 26 is aligned with the vee-jewel 25. Vee-jewel 24 is inserted into the insert 15 and insert 15 is press fit into the pump body 12 thereby capturing the film 29 between the vee-jewels in an orientation such that the reed valves 26 and 28 respectively open and close channels 20 and 22. The vee-jewels 24 and 25 are aligned with channels 20*a* and 22*a* in the pump body. Channels 20*a* and 22*a* are extensions of the inlet 20 and the outlet 22 and communicate with the reservoir 34 in the pump body 12. The film 29 may be adhered at its periphery to the pump body 12 if desired but this is not necessary.

Those skilled in the art will appreciate that the use of vee-jewels is optional. A seat for the reed valve can be fabricated directly in the pump body using conventional injection molding or microfabrication techniques. Vee-jewels are advantageous because they provide a highly polished surface that the reed valves can seat against without leakage.

The film that forms the reed valves can be any material that exhibits the desired flexibility and chemical resistance required in the micropump. While a KAPTON film about 0.0005 inch thick is preferred, other polymeric films having a smooth surface finish could also be used.

Figure 5:
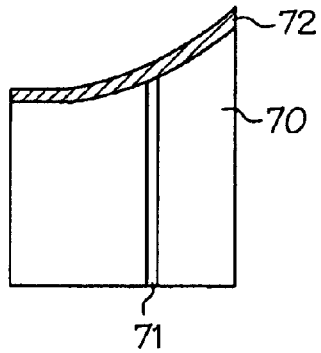
FIG. 5 illustrates a reed valve construction that provides a higher cracking pressure.

In some applications, it may be desirable to design the reed valves to provide a higher valve cracking pressure. If the reed valve sits flatly on the seat, the cracking pressure is zero or minimal and is essentially a function of the stiffness of the film. However, by building stress into the reed valve, a higher cracking pressure can be provided. This can be achieved as illustrated in FIG. 5 using a valve seat 70 with a channel 71. The valve seat 70 is beveled such that when the reed valve is seated, it is under a slight stress produced by the bending in the reed valve from its normal flat position. This causes the film 72 to press against the seat 70 with a small force. This force must be exceeded before fluid can displace the reed from the seat and pass through the valve.

The pumping chamber 14 is formed by a diaphragm 16 and a cavity or reservoir 34. The diaphragm 16 is bonded to the pump body 12 at its periphery such that the diaphragm covers the reservoir 34 of pumping chamber 14. The diaphragm may be secured to the pump body using an adhesive, but the diaphragm is preferably secured by a non-adhesive bonding technique such as melt fusion or ultrasonic welding. In one embodiment of the invention the diaphragm is manufactured from a laminate of polyethylene terephthalate/aluminum/acrylonitrile. In this embodiment, the aluminum reduces permeability of the diaphragm and the acrylonitrile layer of the laminate can be melted to bond the diaphragm to the surface of the DELRIN pump body without using an adhesive or solvents. Bonding the diaphragm without an adhesive or solvent can be very advantageous. The dimensions of the channels and reservoirs in the pump body are very small and, consequently, small amounts of extraneous material such as adhesive can easily clog the pump. By melt bonding the diaphragm directly to the pump body, problems accompanying the use of these extraneous materials are avoided. Adhesives also tend to be susceptible to chemical or oxidative attack. By omitting their use the pump can be used to process materials that could not be processed if the materials interacted with the adhesives.

Important properties to consider in selecting the diaphragm are flexibility, chemical resistance, impermeability, and the ability to bond the diaphragm to the actuator without adhesive. The materials for the diaphragm and the pump body are preferably selected so that an adhesive is not required to bond the diaphragm to the pump body. Diaphragms that require minimal force to deflect such as low modulus films are particularly useful. In this way, the force of the actuator is directed to producing pressure as opposed to deforming the film forming the diaphragm. Less force is required to obtain a given stroke volume than would be required of a higher modulus material formed the diaphragm. The diaphragm may be about 0.005 inch thick in one embodiment of the invention.

In some cases the presence of a metal film within the diaphragm can cause electrical interference. The metal film can pick up signals within the pump or cause an electrical short. In this case it is desirable to use a nonconductive impermeable film as the diaphragm. One useful high voltage compatible, non-conductive film is a polychlorotrifluoroethylene (PCTFE)/acrylonitrile laminate sold under the name ACLAR™ by Honeywell Corp.

The invention is being illustrated using circular diaphragms but the diaphragm could be a film that is integrated into the micropump as a layer that covers the reservoir or cavity in the pumping chamber. For example, this film could be a continuous layer that is bonded to the surface of the micropump body in the process manufacturing the pump body.

Figure 11A:
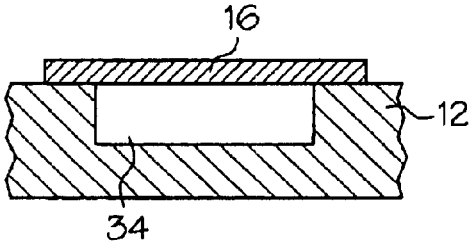
FIGS. 11A and 11B illustrate a cupped diaphragm in accordance with one embodiment of the invention
Figure 11B:
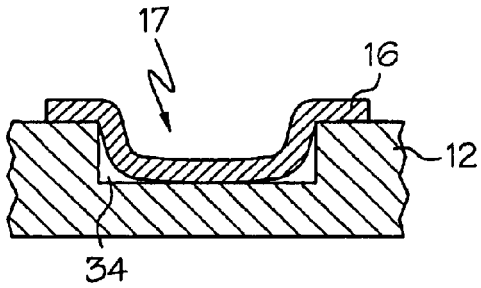

In accordance with one embodiment of the invention, the diaphragm is cupped. The diaphragm is formed from a conformable film that tends to deform to form a cup or dish when it is thermally bonded to the pump body at its periphery. This is illustrated in FIG. 11 where FIG. 11A illustrates the circular diaphragm 16 on the surface of the micropump body 12 prior to bonding. This diaphragm includes a meltable thermoplastic (acrylonitrile) film that is positioned against the pump body 12. Upon heating the circular diaphragm to bond it to the pump body, the diaphragm accumulates in the reservoir 34 and forms a cupped portion 17 as shown in FIG. 11B. Cupping enhances the pumping action of the diaphragm and more efficient actuator force. Because, the diaphragm is not under tension, the actuator does not have to overcome or compete with latent tension in the diaphragm to drive the pump. An additional way to cup the diaphragm is to preform it into a cupped shape.

When the diaphragm is formed from a cupped film as shown in FIG. 11B, the pumping force is a direct function of the width of the actuator. In accordance with a particular embodiment, the pressure generated by the pump is a function of the pumping force which in turn is a direct function of the width of the actuator. The pumping force is not a function of the elasticity of the diaphragm in this embodiment. A direct relationship between pumping force and the width of the actuator facilitates pump design. The flow rate achieved in a pump is a function of the rate and deflection of the diaphragm (i.e., stroke volume) which in turn is a function of the effective length of the actuator and the frequency with which it vibrates. It is usually possible to select a pump actuator that is large enough to provide the desired pressure and flow rate. One advantage of using a strip actuator in the pump is that the remainder of the pump construction is relatively independent (or not directly limited by) the width of the actuator. Different actuator widths can be accommodated in a single pump design. This enables one to provide pumps having different pumping pressure capabilities by using actuators of different widths.

The actuator 40 can be made from a commercially available piezoelectric ceramic. The preferred piezoelectric ceramics are lead zirconate titanate, class 5H. Class 5A piezoceramics may also be used, but require higher voltages to achieve similar motion to class 5H piezoceramics. These actuators are usually formed of two layers of a piezo ceramic. In one embodiment, the actuator 40 contains two layers of piezoelectric ceramic (not shown) separated by a layer or shim that may be made of brass or other material. The application of an electric field across the two layers of the piezoelectric ceramic causes one layer of the ceramic to expand while the other layer of the ceramic contracts. This results in a warpage or curvature of the actuator which is greater than the change in the length or thickness of the piezoelectric ceramic itself. The warpage causes the ends of the actuator to bend relative to the middle of the actuator. If the polarity of this voltage is reversed, the opposite effect is achieved and the actuator bends in the opposite direction.

A piezoelectric strip actuator useful in providing a pump capable of pumping about 0.4 to 100 microliters per second may have a width of approximately 1 to 3 mm. and an effective length of approximately 5 to 30 mm. The term "effective length" refers to the distance between the points 47 and 48 at which the actuator is pinned to the pump body. Of course, in theory there are only practical limits on the size of the actuator.

The actuator 40 can be fixed to the diaphragm 16 by an adhesive 45. The adhesive may be a pressure sensitive adhesive, a UV curable adhesive, a cyanoacrylate adhesive, or the like. Constructions are also feasible which bond the diaphragm to the actuator without an adhesive, e.g., by inserting the actuator through a sleeve in the diaphragm. In the illustrated embodiment, the ends of the actuator are joined by adhesive to the pump body via spacers 42 and 44. These spacers may be formed from the same laminate as the diaphragm 16 itself. As previously mentioned, these spacers provide a flexible mount that permits the ends of the actuator to flex or pivot. Other flexible films that permit end flexing may also be used.

In another embodiment, the actuator is directly connected to the diaphragm. For example the diaphragm may include a loop of film through which the actuator passes.

FIGS. 12 and 13 illustrate another embodiment of the invention in which the actuator is pinned on a small round wire. The end of the actuator 40 is bound to the pump body 12 by an elastic band 50 that is retained in a pair of vertical channels 52 in the pump body 12 by a pair of barbs 54 that are captured within cut outs in the walls of the channels 52. The actuator is pinned on the wire 60 which is retained on the face of the pump body 12 between two sets of retaining blocks 62. The wire 60 can vary in diameter. In one embodiment it is about 0.005 inch.

In the embodiment shown in FIG. 1 the pump has a single pumping chamber. The application of a voltage to the actuator strip causes the strip to warp in one direction and raise the diaphragm, and application of the opposite polarity voltage causes the strip to warp in the opposite direction and lower the diaphragm. When the diaphragm is raised, a vacuum or reduced pressure is caused in the chamber 14 which opens the reed valve 28 and draws fluid into the pumping chamber 14 through the inlet channel 20. The reduced pressure on the reed valve 26 draws that reed into contact with the base of the vee-jewel 25. This temporarily closes the outlet channel 22 as the reservoir 34 is filled. When the diaphragm 16 is lowered, the reed valve 28 is forced into seating contact with the polished base of the vee-jewel 24, the inlet channel 20 is temporarily closed, and fluid is forced out of the reservoir 34 through the outlet channel 22. The mouth 36 of the outlet channel 22 is recessed so that the pressure applied to the reed valve 26 when the diaphragm 16 is lowered does not close the outlet channel 22. Instead the fluid in the reservoir 34 passes around the reed valve 26 and out the outlet channel 22. In this construction, the pump outputs fluid during one-half of the pumping cycle, namely, when the diaphragm 16 is lowered.

Figure 8:
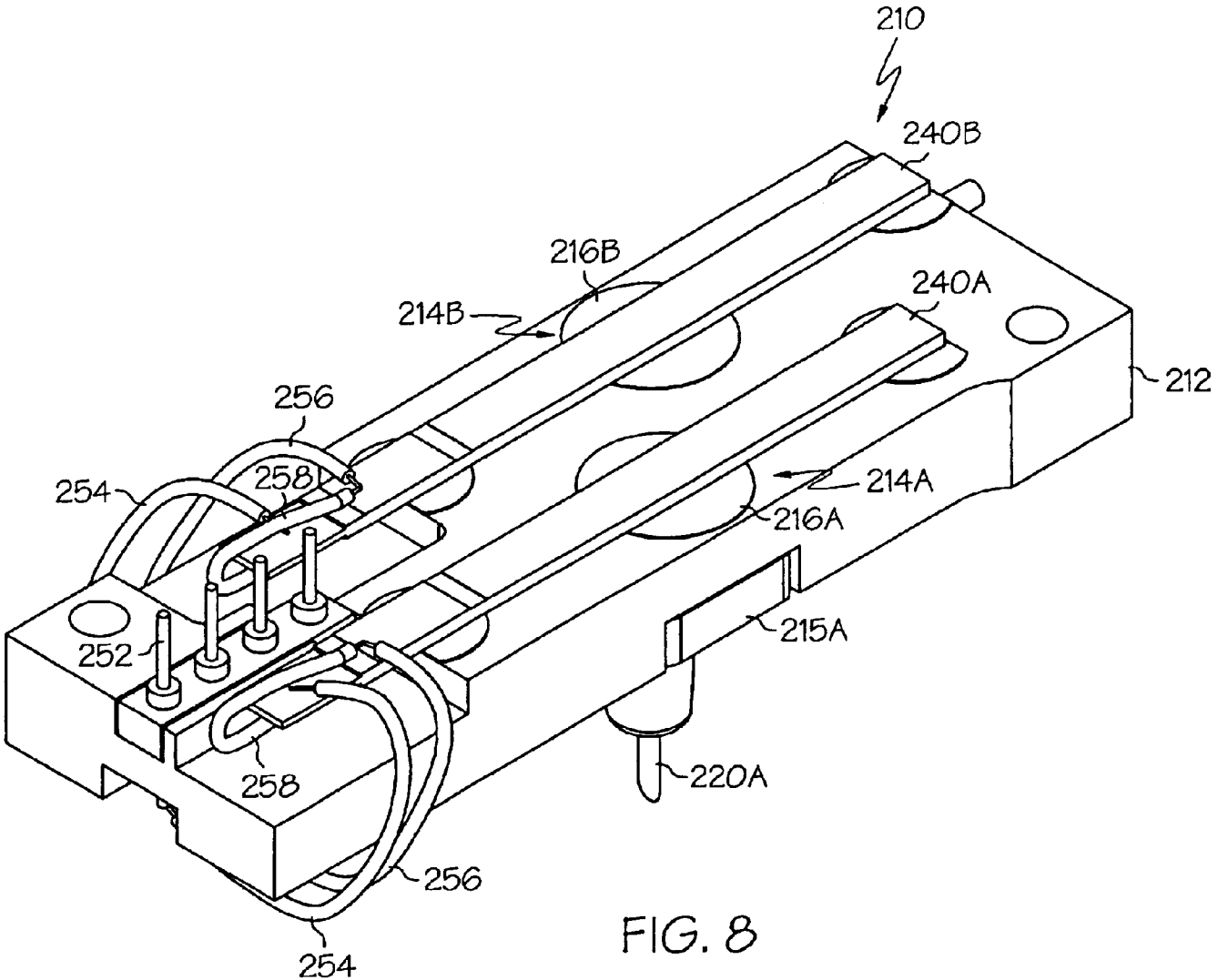
FIG. 8 is a perspective view of a micropump having independently actuated pumping chambers.

The voltage is applied to the actuator by leads which are not shown in FIGS. 1-3. The leads can be attached to the piezoelectric ceramic in a parallel or in a series circuit. In one embodiment, the leads are attached to form an RC circuit. One lead can be attached to each of the layers of ceramic making up the actuator. Alternatively as shown in FIG. 8, a negative lead 256 can be attached to each ceramic layer via a jumper wire 258 and a positive lead 254 can be attached to the shim. The signal that is applied to the ceramic to drive it is preferably applied in a way that reduces noise and vibration. In one case, initially the drive signal rapidly accelerates the actuator and then gradually decreases the vibration frequency.

Figure 6:
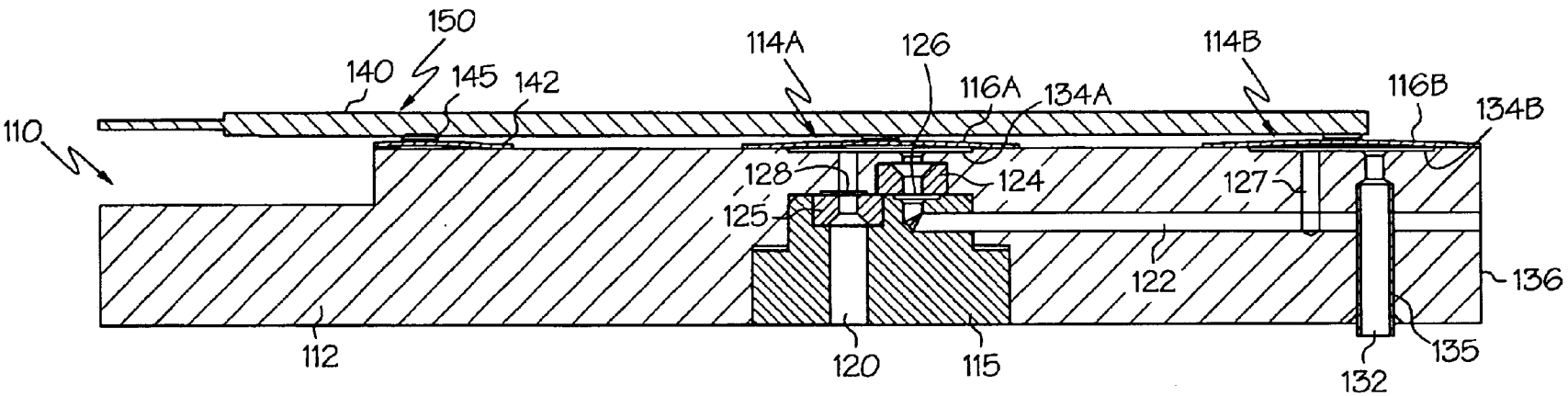
FIG. 6 is a cross-section of a micropump having a pumping chamber and a volume accumulator which are operated in series by a single actuator.
Figure 7:
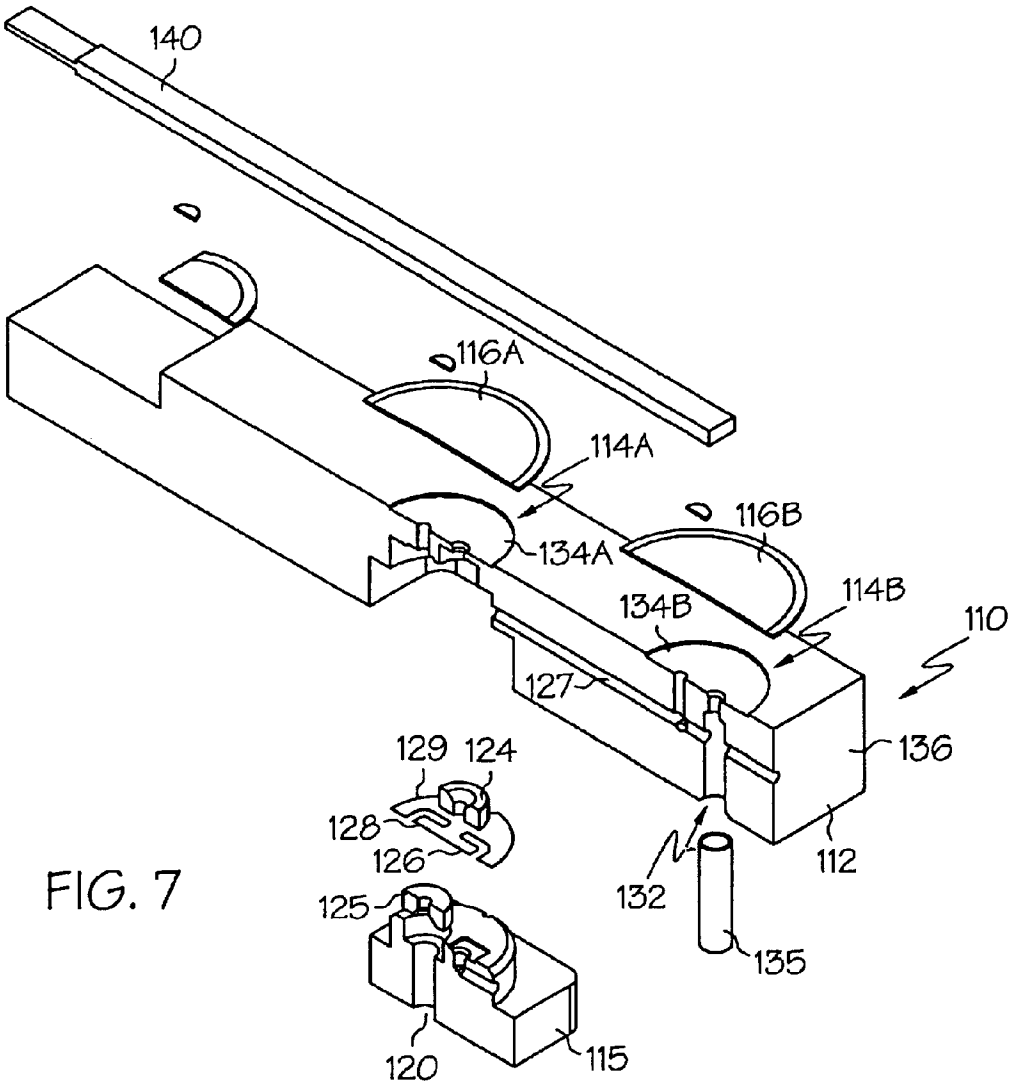
FIG. 7 is a cross-sectional exploded view of a micropump having a first pumping chamber and a volume accumulator which are individually actuated by dedicated actuators.

FIG. 6 and FIG. 7 illustrate an embodiment in which a micropump 110 includes a micropump body 112 that has a primary pumping chamber 114A and a secondary pumping chamber or volume accumulator 114B. These chambers are each covered by diaphragms 116A and 116B, respectively. The primary pumping chamber is associated with an insert 115, a pair of vee-jewels 124 and 125 and a reed film 129 having reed valves 126 and 128 cut therein. The insert, the vee-jewels and the reed film are assembled with the pump body 112 in the same way as has been disclosed for the embodiment shown in FIGS. 1-3. The second pumping chamber 114B is a volume accumulator in this embodiment. Consequently the insert and vee-jewels are not required and the channels feeding and emptying the reservoir 134B can be readily formed directly into the pump body 112. In this embodiment of the invention the micropump 110 includes one actuator 140 that is secured to both the first and second diaphragm 116A and 116B and pinned to the pump body at end 150 by a spacer 142 and a drop of adhesive 143. With this construction, application of a voltage to the actuator 140 deforms the actuator such that one of diaphragms 116A and 116B is raised by the actuator 140 (e.g., the diaphragm located in the middle of the actuator) while the other of the diaphragms is lowered (e.g., the diaphragm located at an end of the actuator). Reversing the polarity of the voltage has the reverse effect, the diaphragm at the end of the actuator may be raised while the diaphragm at the middle of the actuator may be lowered.

The micropump 110 can be constructed and used in a manner that provides a more consistent flow than the single chamber micropump 10 of FIG. 1. In this embodiment the outlet channel 122 from the first chamber 114A feeds the volume accumulator chamber 134B by means of vertical channel 127. Channel 122 is shown extending from chamber 134A to the end 136 of the pump body 12. To close access to channel 122 from the vertical channel 132, channel 132 is lined with a tube member 135. In the first half of the pumping cycle a voltage is applied to the actuator 140 such that the middle of the actuator moves up, and the ends move down. This movement simultaneously pulls the primary pumping chamber diaphragm 116A up, and pushes the volume accumulator diaphragm 116B down. The movement of the primary pumping chamber diaphragm up creates a pressure differential which seals the outlet reed valve 126 against the seat of the vee-jewel 124 and opens the inlet valve 128 and draws the medium in through the inlet reed valve 128 and inlet 120. The movement of the diaphragm 116B downward discharges any medium in the chamber 134B via the outlet tube 135.

In the second half of the pumping cycle the polarity of the voltage applied to the actuator 140 is reversed such that the middle of the actuator 140 moves down, and the ends move up. This movement simultaneously pushes the diaphragm 116A down and pulls the diaphragm 116B up. The movement of the diaphragm 116A down creates a pressure differential which seals the inlet valve 128 against the vee-jewel 124 and opens the outlet valve 126. This movement also simultaneously forces the medium in the chamber 114A into the expanding chamber 114B via the interconnecting passage 122, while fluid in excess of the volume of the chamber 114B is discharged to the outlet tube 132. The flow to the outlet tube 135 is a function of the differential of the volumes of chambers 114A and 114B which in this embodiment may be 2:1 but may be varied as a matter of design choice. For example, during the first half of the pumping cycle, two units of fluid may be drawn into the primary pumping chamber 114A while one unit of fluid is forced from the secondary pumping chamber 114B. During the second half of the pumping cycle, two units of fluid may be forced from the primary pumping chamber 114A. One of these two units may fill the secondary pumping chamber 114B while the other unit may pass through the secondary pumping chamber and be dispensed from the outlet tube 135.

Figure 9:
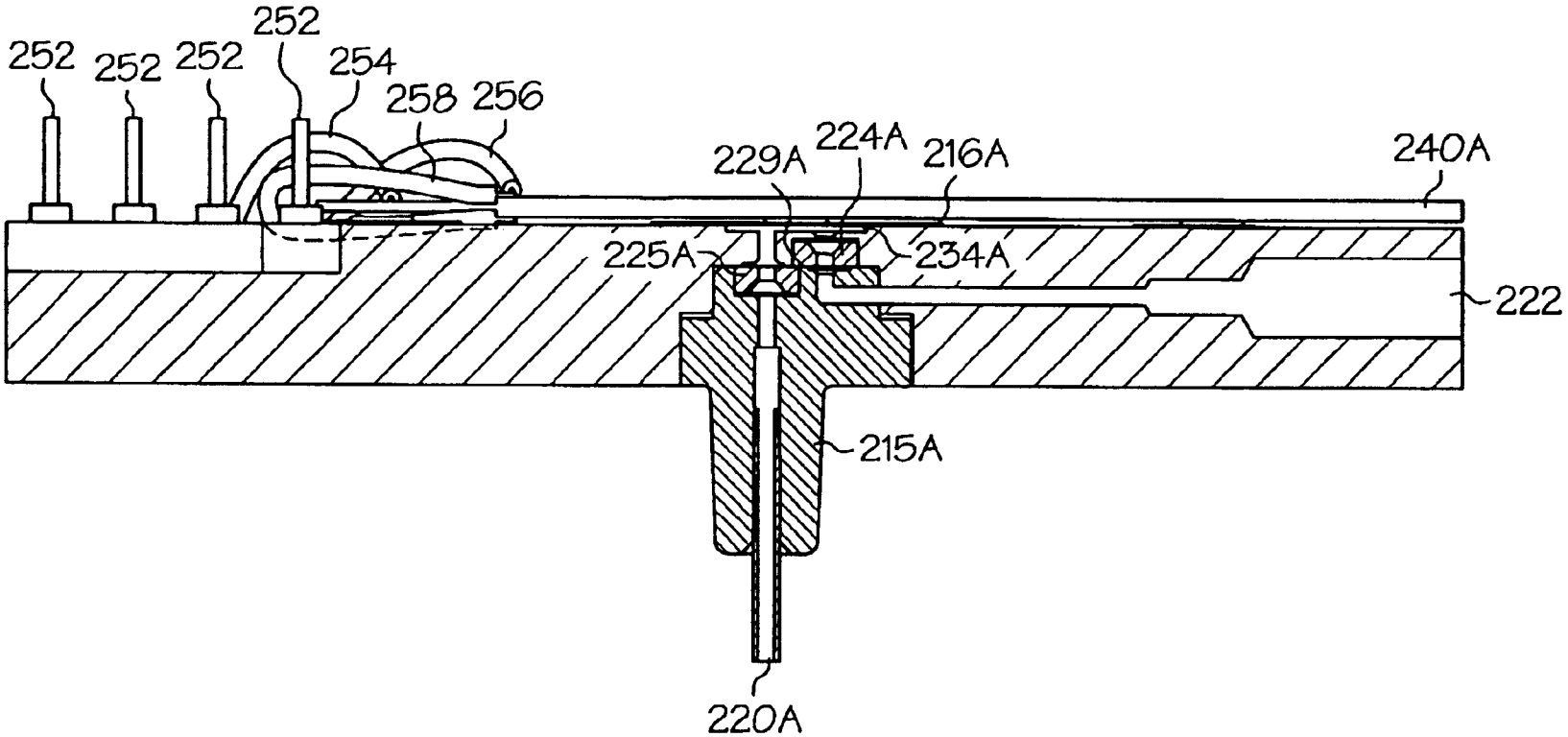
FIG. 9 is a cross-section of the micropump of FIG. 8.
Figure 10:
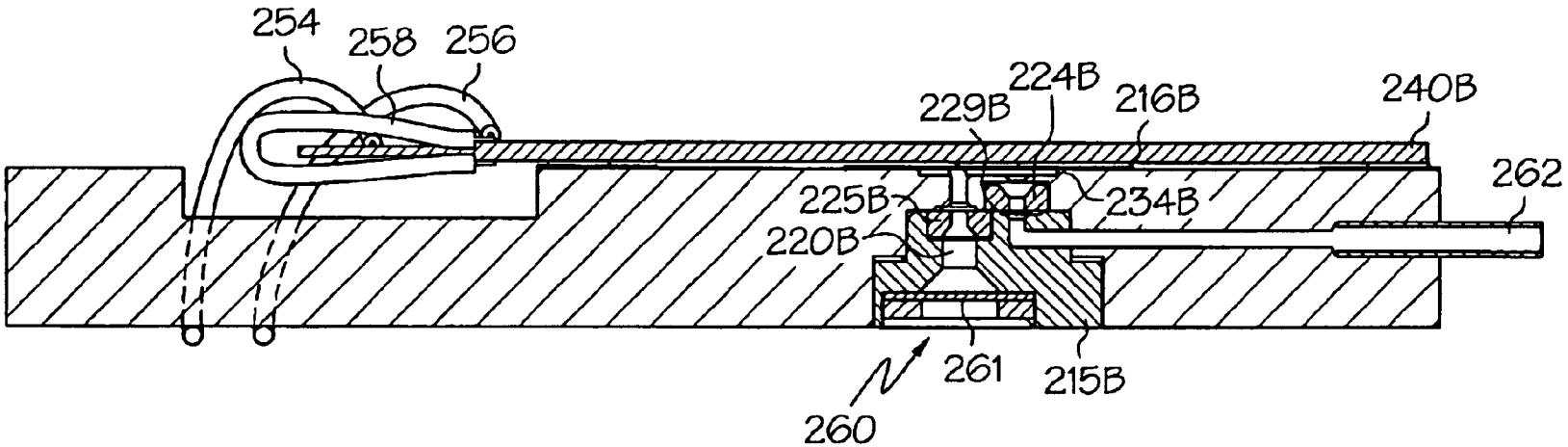
FIG. 10 is another cross-section of the micropump of FIG. 8.

FIGS. 8-10 illustrate another embodiment of the invention where the micropump 210 includes a pump body 212 having a pair of pumping chambers 214A and 214B which are formed by a pair of diaphragms 216A and 216B. These diaphragms are controlled individually by a pair of actuators 240A and 240B. Pins 252 are provided to make electrical connections to the actuators from a controller (not shown). The pumping chambers 214A and 214B are otherwise constructed and manufactured in the manner illustrated in FIG. 1. In one example of this embodiment of the invention, the pumping chamber 214A is used to pump a liquid fluid such as a pharmaceutical or analytical formulation, and pumping chamber 214B is used to pump a gas such as air that can be used to purge one or more elements of the liquid pumping fluidics such as a dispenser nozzle. This is illustrated in more detail in FIGS. 9 and 10 which are cross-sections through the micropump of FIG. 8. In FIG. 9, the liquid pumping module 214A includes a liquid inlet 220A in an insert 215A. Inlet tube 220A may be a hypodermic needle that draws medicament from a container. In a manner directly analogous to FIG. 1, the micropump is assembled using a pair of vee-jewels 224A and 225A and a reed film 229A having reed valves therein. Actuator 240A raises and lowers the diaphragm 216A. When the diaphragm is raised, liquid is drawn into the reservoir 234A through the inlet 220A. When the diaphragm is lowered, liquid is expelled through the outlet 222. Similarly, the micropump shown in FIG. 10, for pumping air, is assembled from an insert 215B that includes an air filter 261 through which air is drawn into the reservoir 234B via inlet tube 220B. Again, a pair of vee-jewels 224B and 225B provide seats for the reed valves in the film 229B. When the diaphragm 216B is raised, air is drawn into the air inlet 260. When it is lowered, air is expelled through the outlet 262. The outlet 262 from the air module and the outlet 222 from the liquid module can feed a three way connection to a spray nozzle (not shown). The three way connection optionally includes a valve to control which branch (air from line 262 or liquid from line 222) feeds the nozzle. After spraying liquid, air may be pumped through the spray nozzle to remove any solution that otherwise might leave residue in the nozzle. In an alternative embodiment, the pumping chamber 214B may be used to pump another purging fluid such as water.

The micropump of the present invention is particularly useful in a dosing device in metering solutions or suspensions of a medicament. In one embodiment, it is used in an inhaler where the micropump is used to withdraw a fixed amount of a solution or suspension of a medicament from a supply vessel and pump it to an aerosol sprayer. More particularly, the micropump is useful in metering dosages to EHD (electrohydrodynamic) aerosol sprayers such as the sprayers disclosed in U.S. Pat. No. 6,302,331 to Dvorsky et al.

The micropump of the invention can be supplied by a liquid containment system of the type described in commonly assigned U.S. application Ser. No. 10/187,477 filed contemporaneously herewith. In this case the inlet tube 220A may be a needle that punctures a septum in the container and withdraws liquid medicament as described herein.

Having described the invention in detail and by reference to specific embodiments thereof, it will be apparent that numerous modifications and variations are possible without departing from the spirit and scope of the following claims.

What is claimed:

1. A micropump comprising:

a pump body including a fluid inlet channel, a fluid outlet channel and pumping reservoir, the fluid inlet channel and the fluid outlet channel communicating with the pumping reservoir, a diaphragm covering the pumping reservoir, a piezoelectric strip actuator attached to the diaphragm such that by applying a voltage to the actuator, the diaphragm can be raised or lowered relative to the pumping reservoir and wherein the piezoelectric strip actuator has two ends and is mounted in the micropump in a manner that permits both ends of the actuator to flex when a voltage is applied to the actuator, and a valve on the inlet channel and the outlet channel, the valve opening and closing the inlet and the outlet channel in response to the raising and lowering of the diaphragm.

2. The micropump of claim 1 wherein the micropump generates a pumping force that is essentially a direct function of the width of the actuator.

3. The micropump of claim 1 wherein the valves on the inlet and outlet channels are reed valves.

4. The micropump of claim 3 wherein the reed valve is stressed to increase the cracking pressure or the back pressure.

5. The micropump of claim 3 wherein the reed valves are constructed from a single film of a flexible polymer.

6. The micropump of claim 5 wherein the film is an aromatic polyimide.

7. The micropump of the claim 5 wherein the reed valves are formed from a film of a flexible polymer having a first cut out therein defining a first flexible flap and second cut out therein defining a second flexible flap, one of said flexible flaps being aligned with the inlet channel and the other of the flexible flaps being aligned with the outlet channel.

8. The micropump of claim 1 wherein the diaphragm is cupped.

9. The micropump of claim 8 wherein the diaphragm is a laminate that includes a gas impermeable film and a layer of a polymer that can be melt bonded to the pump body.

10. The micropump of claim 9 wherein the diaphragm is a laminate of polychlorotrifluoroethylene.

11. The micropump of claim 1 wherein the piezoelectric actuator is mounted on a pair of flexible pads at each end of the actuator.

12. A micropump comprising:

a pump body having a fluid outlet channel, a fluid inlet channel, a first pumping reservoir and a second pumping reservoir, first and second diaphragms covering respectively the first and second pumping reservoirs, a piezoelectric strip actuator attached to both the first and second diaphragms such that by applying a first voltage to the actuator, the first diaphragm can be raised and the second diaphragm lowered relative to the pumping reservoirs and upon applying a second voltage to the actuator, the first diaphragm can be lowered and the second diaphragm can be raised relative to the pumping reservoirs wherein the piezoelectric strip actuator has two ends and is mounted in the micropump in a manner that permits both ends of the actuator to flex when a voltage is applied to the actuator, and valves on the inlet channel and the outlet channel.

13. The micropump of claim 12 wherein the valves on the inlet and outlet channels are reed valves.

14. The micropump of claim 13 wherein the reed valve on the inlet channel or the outlet channel is stressed to increase the cracking pressure.

15. The micropump of claim 14 wherein the reed valves are constructed from a single film of a flexible polymer.

16. The micropump of claim 15 wherein the film is an aromatic polyimide.

17. The micropump of claim 12 wherein the diaphragm is cupped.

18. The micropump of claim 17 wherein the diaphragm is a laminate of an impermeable film and a layer of a polymer that can be melt bonded to the pump body.

19. The micropump of claim 12 wherein the piezoelectric actuator is mounted on a pair of pads at each end of the actuator.

20. A micropump comprising:

a pump body including a fluid inlet channel, a fluid outlet channel and pumping reservoir, the fluid inlet channel and the fluid outlet channel communicating with the pumping reservoir, a diaphragm covering the pumping reservoir, a piezoelectric strip actuator attached to the diaphragm such that by applying a voltage to the actuator, the diaphragm can be raised or lowered relative to the pumping reservoir wherein the actuator is mounted on the pump body such that at least one end of the actuator oscillates when an electric voltage is applied, and a valve on the inlet channel and the outlet channel, the valve opening and closing the inlet and the outlet channel in response to the raising and lowering of the diaphragm.

21. The micropump of claim 20 wherein the actuator is mounted on the pump body such that both ends oscillate when an electric voltage is applied.

22. The micropump of claim 21 wherein at least one of end of the actuator is supported on a wire and the actuator oscillates on the wire.

23. The micropump of claim 22 wherein both ends of the actuator are supported on wires and oscillate on the wires.

24. A micropump comprising a pump body having a fluid inlet channel, a fluid outlet channel, a first pumping chamber and a second pumping chamber, a first diaphragm covering the first pumping chamber and second diaphragm covering the second pumping chamber, a first piezoelectric strip actuator attached to the first diaphragm such that by applying a voltage to the actuator, the diaphragm can be raised or lowered relative to the first pumping chamber, a second piezoelectric strip actuator attached to the second diaphragm such that by applying a voltage to the second actuator, the second diaphragm can be raised or lowered relative to the second pumping chamber, wherein at least one of the piezoelectric strip actuators has two ends and is mounted in the micropump in a manner that permits both ends of the actuator to flex when a voltage is applied to the actuator, and an inlet valve in the inlet channel and an outlet valve in the outlet channel, the inlet and outlet valves opening and closing the inlet and outlet channels in response to raising and lowering the diaphragms.

25. A dosing device comprising a micropump and a supply of a medicament, the micropump pumping the medicament from the supply; wherein the micropump includes a pump body including a fluid inlet channel, a fluid outlet channel and pumping reservoir, the fluid inlet channel and the fluid outlet channel communicating with the pumping reservoir, a diaphragm covering the pumping reservoir, a piezoelectric strip actuator attached to the diaphragm such that by applying a voltage to the actuator, the diaphragm can be raised or lowered relative to the pumping reservoir, wherein the piezoelectric strip actuator has two ends and is mounted in the micropump in a manner that permits both ends of the actuator to flex when a voltage is applied to the actuator, an inlet valve on the inlet channel and an outlet channel on the outlet channel, the valves opening and closing the inlet and the outlet channels in response to the raising and lowering of the diaphragm.

* * * * *